United States Patent [19]

Petitpierre

[11] Patent Number: 4,754,882

[45] Date of Patent: Jul. 5, 1988

[54] MAGNETIC SCRAP BLOCK

[76] Inventor: Marc A. Petitpierre, 433 Muddy Branch Rd., #102, Gaithersburg, Md. 20878

[21] Appl. No.: 849,278

[22] Filed: Apr. 8, 1986

[51] Int. Cl.[4] ..... B03C 1/30; B02C 23/08

[52] U.S. Cl. ..... 209/636; 209/215; 209/224; 241/81

[58] Field of Search ..... 209/636, 926, 930, 213–215, 209/223.1, 224, 231; 241/46 A, 46 B, 68, 79, 81, 100.5; 4/629, DIG. 4

[56] References Cited

U.S. PATENT DOCUMENTS

| | | | |
|---|---|---|---|
| 689,561 | 12/1901 | McKenna | 209/224 |
| 1,720,386 | 7/1929 | Troiel | 15/245 X |
| 2,824,702 | 2/1958 | Lee | 241/100.5 X |
| 2,869,795 | 1/1959 | Higer | 241/81 |
| 2,992,735 | 7/1961 | Troy | 209/223.1 |
| 3,163,371 | 12/1964 | Hardy | 241/100.5 |
| 3,420,455 | 1/1969 | Chorney | 241/100.5 X |
| 3,662,425 | 5/1972 | Klein et al. | 241/100.5 |
| 3,926,792 | 12/1975 | Buford | 209/636 |
| 4,067,810 | 1/1978 | Sullivan | 209/224 X |
| 4,367,138 | 1/1983 | Kustas | 209/636 X |
| 4,494,657 | 1/1985 | Oldenkamp | 209/636 |

FOREIGN PATENT DOCUMENTS

| | | | |
|---|---|---|---|
| 2170737 | 8/1986 | United Kingdom | 209/636 |

OTHER PUBLICATIONS

Baby KatchAll Flatware Retriever advertising brochure, Katchall Industries Midwest, Inc., date unknown.

*Primary Examiner*—David A. Scherbel
*Assistant Examiner*—Edward M. Wacyra
*Attorney, Agent, or Firm*—Fay, Sharpe, Beall, Fagan, Minnich & McKee

[57] ABSTRACT

A substantially cylindrically shaped rubber scrap block is mounted over a variable size opening on a steel dish cleaning table with any type of disposal system located below the table. The interior of the scrap block includes a plurality of magnets partially embedded in the interior wall thereof in a specific preferred configuration and a slitted flexible diapram attached to the wall intermediate the ends of the scrap block. The exterior of the scrap block deviates from its substantially cylindrical shape only by an alteration of the outside diameter so that it fits any standard opening as various disposal systems have different dimensional specifications. Wastes scraped from dishware pass through the scrap block to be disposed but stainless steel flatware and other metal items are attracted to and held by the magnets.

5 Claims, 2 Drawing Sheets

MAGNETIC SCRAP BLOCK

BACKGROUND OF THE INVENTION

The present invention is directed toward a metallic recovery scrap block and more particularly toward such a scrap block which can replace conventional blocks but which includes a specific preferred magnet means for preventing the inadvertent loss of metal items and adaptable means for use with any disposal system.

As is well known in the food service industry, the loss of silverware and other metal items such as shakers, etc., is a very serious problem which costs operators large sums of money not only in replacement costs but also in repair, maintainance, and down time costs. The problem stems from careless kitchen help and the manner in which wastes are removed from used dishes during cleaning operations.

Many modern kitches utilize stainless steel tables for pre-sorting dishware as part of clean-up operations. Such tables conventionally carry a scrap block which is comprised of a hard rubber cylindrical member approximately six inches high and seven inches in diameter. The scrap block is mounted with its axis vertical over an opening in the stainless steel table which overlies a disposal system there below. In use, a plate with food or debris and the like is tapped vertically over the scrap block so that the debris from the plate falls through the opening in the center of the scrap block. Any flatware or other metal items which was on the plate or which may have been hidden in the debris would fall through the center of the scrap block into the disposal system without the kitchen help knowing of the same.

While this method is standard operating procedure in most dishrooms, the disposal systems vary considerably as garbage cans or various types of garbage disposals are used. This variety necessitates additional characteristics of the scrap block that incorporate safety features such as a splash guard and an adaptable means to fit any standard size openings required by specifications of different disposal systems.

Inventions have been proposed in an attempt to alleviate the problem of lost flatware. One such proposal is described in U.S. Pat. No. 4,367,138. This patent is directed toward a scrap block which uses magnet means to prevent inadvertent loss of flatware in much the same fashion as the present invention. This system, however, impedes the flow of wastes through the interior of the scrap block because of its hourglass shape. Furthermore, even the market version of this proposal cannot be used in conjunction with a garbage disposal. Other inventions have been proposed but they are inefficient, complex, take up a great deal of premium space in a dishroom, are prohibitively expensive, and cannot be adapted for use in a dishroom equipped with a garbage disposal.

Inventions have also been proposed for flatware recovery specifically for garbage disposal systems. For example, U.S. Pat. No. 2,869,795 describes a device for preventing damage to a garbage disposal caused by silverware. The device includes a tray upon which is intended to be deposited a quantity of garbage. Batches of the garbage can then be pushed through an opening in the tray into the garbage disposal mounted below. A plurality of magnets mounted beneath the tray attract the silverware or other metal objects to prevent them from being pushed into the opening. While this device may have some usefulness, it is not easily adaptable to a stainless steel table such as described above as additional scraper means would be necessary. Furthermore, this device can only be used with garbage disposal units.

SUMMARY OF THE INVENTION

The present invention is believed to eliminate or at least substantially reduce the loss of metal items in a very simple and inexpensive manner and can be used in any dishroom which is not capable of being accomplished with the devices described above. With the present invention, a substantially cylindrically shaped rubber scrap block is mounted over a variable size opening on a steel dish cleaning table with any type of disposal system located below the table. The interior of the scrap block includes a plurality of magnets partially embedded in the interior wall thereof in a specific preferred configuration and a slitted flexible diaphram attached to the wall intermediate the ends of the scrap block. The exterior of the scrap block deviates from its substantially cylindrical shape only by an alteration of the outside diameter so that it fits any standard opening as various disposal systems have different dimensional specifications. Wastes scraped from dishware pass through the scrap block to be disposed but flatware and other metal items are attracted to and held by the magnets.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
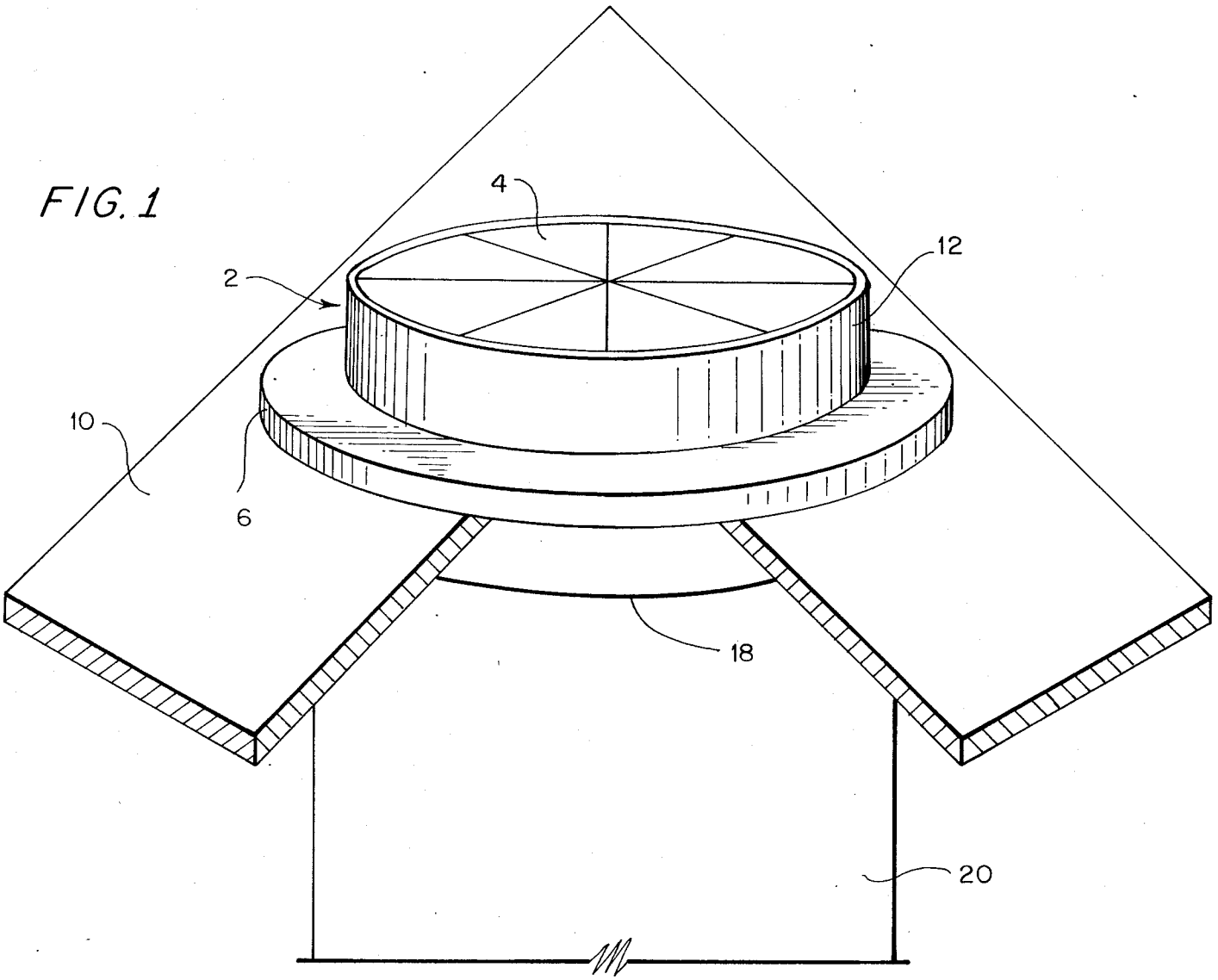
FIG. 1 is a perspective view of a magnetic scrap block constructed in accordance with the principles of the present invention and shown in use on a stainless steel table, part of which has been broken away for clarity.
Figure 2:
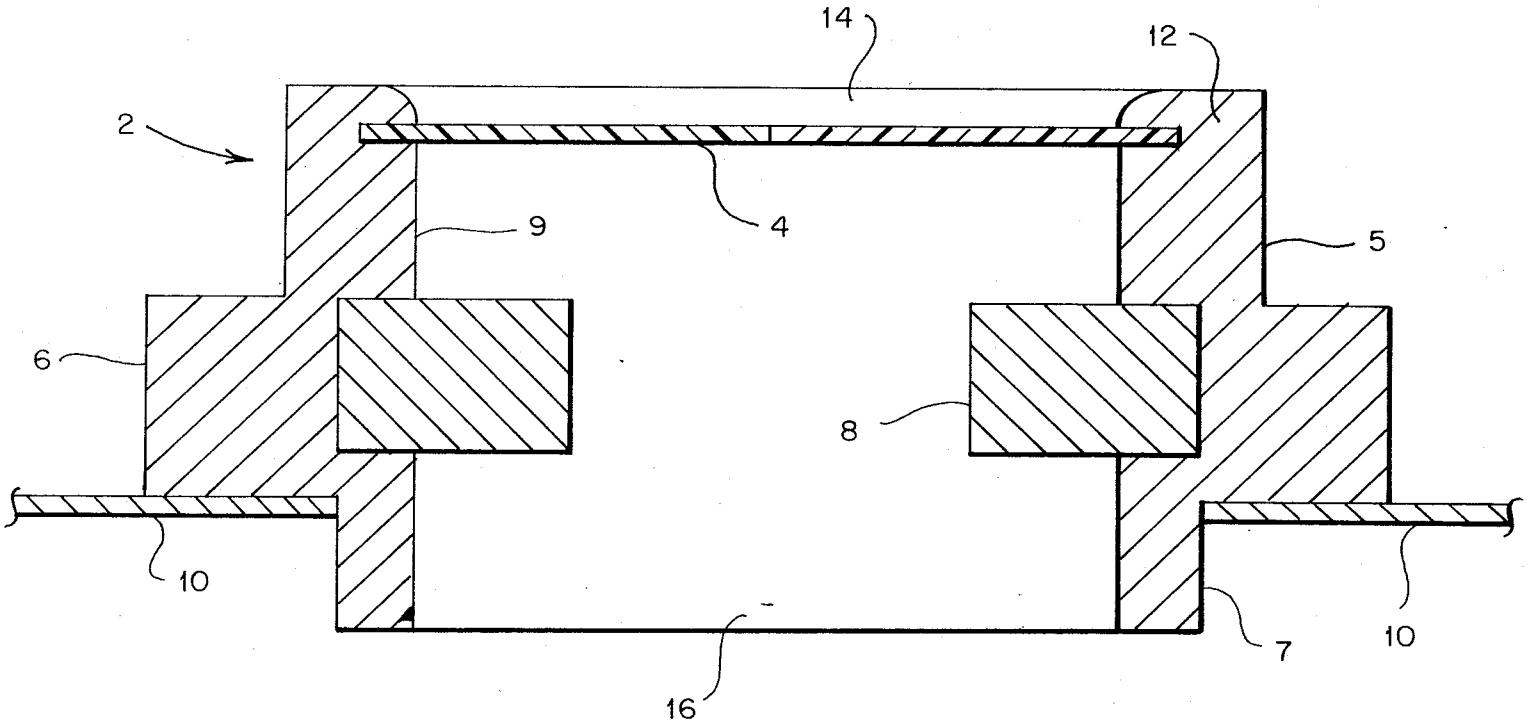
FIG. 2 is a cross-sectional view showing a vertical section through the axis of the device.

Referring now to the drawing in detail wherein like reference numerals have been used throughout the various figures to designate like elements, there is shown in FIGS. 1 and 2 a magnetic scrap block constructed in accordance with the principals of the present invention and designated generally as 2.

Magnetic scrap block 2 is comprised of a substantially tubular member 12 which, in the preferred embodiment, is circular in cross section. Tubular member 12 has a height of approximately six inches and an overall diameter of approximately seven inches. This is, of course, by way of example only as other sizes could be utilized. Preferably, the tubular membrane 12 is comprised of a polymeric material such as hard rubber, neoprene or the like.

Tubular member 12 has an opening 14 at the top or upper end thereof and a similar opening 16 at the bottom. As shown most clearly in FIG. 2, the interior of the tubular member 12 is substantially cylindrical. Partially embedded and bonded in the interior wall 9 of the tubular member 12 are a plurality of magnets 8. As is best shown in FIG. 2, the magnets 8 are partially embedded in the wall so that the magnetic field that runs the length of the magnets 8 is extended as far as necessary to the center of the tubular member 12. Rod or cylindrical magnets are preferred to maximize flow of waste from the top opening 14 through the bottom opening 16. Coating the exposed surfaces of the magnets 8 with a non-magnetic insulator is preferable because it would prevent corrosion, chipping, damage to metal items that are combined with waste, and would protect workers' hands from contact without affecting the properties of the magnets 8.

The magnets 8 are preferably mounted adjacent to the extended outer wall 6. Two magnets are shown because the principles of magnetism are based on two opposing poles and more poles would interfere with attraction in this configuration. It would be preferred to use magnets that are of a certain material, grade, and dimensions so that both attraction and holding power are maximized.

To the interior wall 9 of the tubular member 12 is attached a slitted, flexible diaphram 4, preferably intermediate top opening 14 and bottom opening 16 as best shown in FIG. 2. This diaphram 4 not only acts as a "splash guard" when the magnetic scrap block 2 is used in conjunction with a garbage disposal to keep objects from being ejected, but also could slow down metal objects and direct them to the magnetic field. As an added bonus, this diaphram 4 offers further protection from contact with the magnets 8 and some metal utensils trapped by the invention. The outer wall 5 is shown to be substantially cylindrical excepting an extended outer wall 6 to serve as an adapter to overlay any various size openings of different disposal systems and a reduced outer wall 7 of a minimum dimension to fit inside those various size openings and serve to hold the magnetic scrap block 2 stationary.

The magnetic scrap block 2 of the present invention is utilized in substantially the same manner as a conventional scrap block. The magnetic scrap block 2 is mounted on a stainless steel table 10 which has an opening 18 therein in alignment with the openings 14 and 16 in the magnetic scrap block 2 with reduced outer wall 7 fitting inside opening 18 and extended outer wall 6 overlaying steel table 10. A refuse container or garbage disposal 20 is located beneath the table 10. Food, paper and other similar debris from plates which are scraped into the top of the magnetic scrap block 2 fall through the scrap block into the container or disposal 20. Stainless steel flatware and other metal objects, however, are attracted to and held by the magnets 8.

The present invention may be embodied in other specific forms without departing from the spirit or essential attributes thereof and accordingly, reference should be made to the appended claims rather than to the foregoing specification as indicating the scope of the invention.

I claim:

1. A magnetic scrap block for preventing the passage of metal objects into disposal systems, comprising: a generally cylindrical open casing having an interior of a generaly uniform diameter; a lower exterior portion having a diameter to permit vertical placement thereof in the neck of a disposal system; an annular exterior flange disposed above said lower exterior portion of said casing to engage a horizontal surface adjacent said disposal system; at least one pair of opposite magnets, each of said magnets having opposite poles, a longitudinal direction and a length dimension extending in said longitudinal direction between said poles; a portion of the length of one of said magnets being embedded in said casing and a portion of the length of the other of said magnets being embedded in said casing opposite said one of said magnets so that the remainder of the length of each of said magnets extends radially inwardly toward said casing interior with a first one of said one magnet's poles being in facing relation with one of said other magnet's poles that has a polarity opposite to the polarity of said first pole such that a magnetic field is created between said magnets for attracting and holding metal objects passing through said casing; and a flexible diaphragm with apertures provided therein fitted across said casing.

2. The scrap block of claim 1 wherein said casing is made of polymeric material.

3. The scrap block of claim 1 in which a pair of opposed magnets are disposed in the walls of said casing.

4. The scrap block of claim 1 wherein the exterior of said casing is provided with an annular shoulder above said flange.

5. The scrap block of claim 1 wherein said diaphragm is fitted across the interior upper, open end of said casing.

* * * * *